United States Patent [19]

Bonfiglioli et al.

[11] Patent Number: 4,977,880

[45] Date of Patent: Dec. 18, 1990

[54] SYSTEM FOR CONVERTING A SIGNAL FROM A LINEAR TRANSDUCER FOR ENABLING PARAMETER ACQUISITION TO VARYING DEGREES OF ACCURACY

[75] Inventors: Silverio Bonfiglioli, Zola Predosa; Massimo Fato, Modena, both of Italy

[73] Assignee: Weber S.r.l., Turin, Italy

[21] Appl. No.: 307,782

[22] Filed: Feb. 7, 1989

[51] Int. Cl.[5] ..... F02D 41/02

[52] U.S. Cl. ..... 123/488; 173/118.1

[58] Field of Search ..... 123/494, 488; 73/118.1, 73/117.3, 116

[56] References Cited

U.S. PATENT DOCUMENTS

| | | | |
|---|---|---|---|
| Re. 31,906 | 6/1985 | Oyama et al. | 123/494 |
| 3,908,614 | 9/1975 | Ironside et al. | 123/494 |
| 3,948,237 | 4/1976 | Williams et al. | 123/488 |
| 4,280,465 | 7/1981 | Staerzl | 123/494 |
| 4,515,009 | 5/1985 | Hasegawa et al. | 73/118.1 |
| 4,762,108 | 8/1988 | de Concini | 123/494 |
| 4,843,555 | 6/1989 | Hattori et al. | 123/494 |

*Primary Examiner*—Andrew M. Dolinar

*Attorney, Agent, or Firm*—Gifford, Groh, Sprinkle, Patmore and Anderson

[57] ABSTRACT

A system for converting a signal from a substantially linear transducer detecting a parameter on a motor vehicle electronic fuel injection system, and so enabling parameter acquisition to varying degrees of accuracy; wherein the transducer is a potentiometer for detecting the setting of the throttle regulating air intake by the engine; and wherein the conversion system itself comprises an electronic circuit featuring at least one amplifier for supplying at least one signal differing in slope as compared to that supplied by the transducer; and a processing unit for enabling parameter acquisition to a degree of accuracy depending on the modified slope of the signal supplied by the aforementioned electronic means.

17 Claims, 5 Drawing Sheets

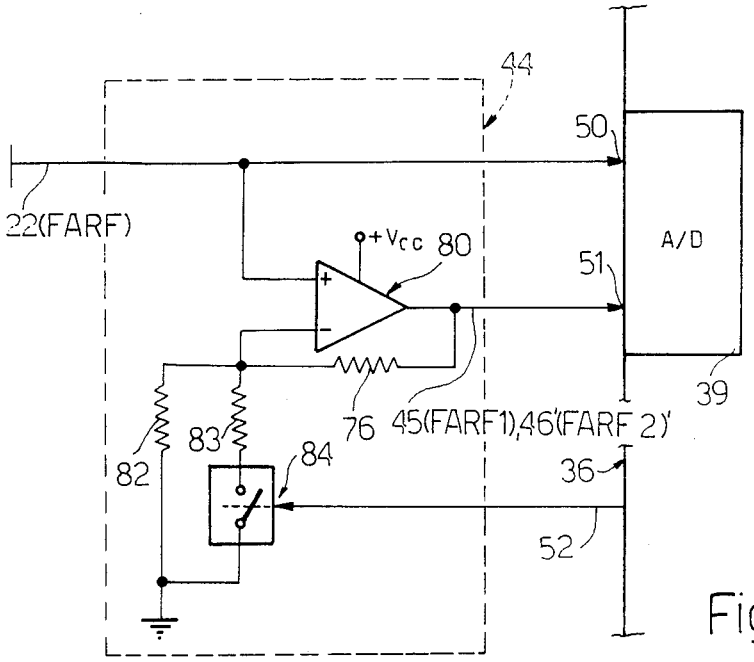
Fig.6
Fig.7
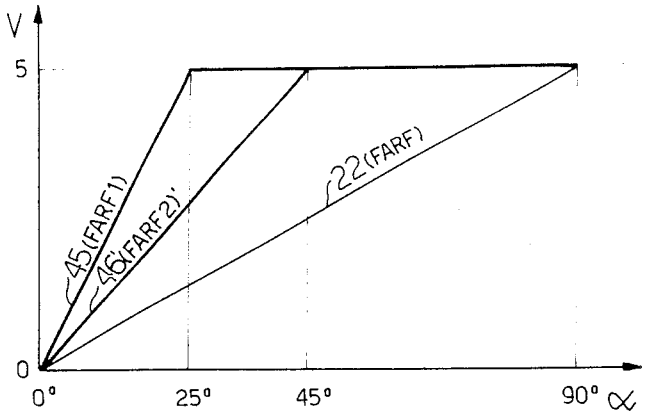

SYSTEM FOR CONVERTING A SIGNAL FROM A LINEAR TRANSDUCER FOR ENABLING PARAMETER ACQUISITION TO VARYING DEGREES OF ACCURACY

BACKGROUND OF THE INVENTION

The present invention relates to a system for converting a signal from a substantially linear transducer detecting a parameter on a motor vehicle electronic fuel injection system, and so enabling parameter acquisition to varying degrees of accuracy. Said conversion system is applied, in particular, for detecting a parameter (in this case, the setting of the throttle regulating air intake by the engine) on an internal combustion engine electronic fuel injection system, of the type comprising an electronic control system wherein a central processing unit receives signals from sensor means and/or transducers detecting major operating parameters, such as engine speed, the setting of the throttle regulating air intake by the engine, and the concentration of exhaust gas components; and wherein said electronic control system provides for controlling final injection preferably via a single-point injection unit: as a function of engine speed and the throttle setting, said central processing unit calculates a basic injection time (determined in open-loop manner) which, depending on various operating conditions, is corrected via parameters supplied by additional sensor means or transducers for detecting at least the engine cooling water and air intake temperatures, and via the signal supplied by the exhaust gas sensor (for determining a controlled injection time in closed-loop manner).

Known injection systems of the aforementioned type differ substantially in terms of the design and operating program of the electronic control system, as a function of the performance demanded of the injection system itself, the components of which are therefore selected and designed on a system cost and required performance basis.

One of the major parameters involved is the setting of the throttle regulating air intake by the engine, which is usually detected by means of potentiometers. Over certain ranges (particularly minimum opening of the throttle), the accuracy of such a system does not always provide for a sufficiently low parameter reading error percentage, which is inevitably reflected in poor injection control timing. One attempt to overcome this drawback has been to replace linear, single-track potentiometers with others producing signals of differing slopes and/or featuring a number of tracks, for enabling different parameter ranges to be read to varying degrees of accuracy. Alternatively, analogue-digital converters have been employed, which receive the signal from the potentiometer, and present a relatively large number of output bits. All these solutions, however, involve considerable cost.

SUMMARY OF THE INVENTION

The aim of the present invention is to provide a system for converting a signal from a normal, substantially linear transducer detecting a parameter on a motor vehicle electronic injection system, and so enabling parameter acquisition to varying degrees of accuracy; which system is relatively cheap to produce, and provides for required reading accuracy over even widely differing parameter ranges, thus enabling it to be applied to relatively low-cost electronic injection systems, while at the same time ensuring optimum performance, comparable to that of more sophisticated systems, by virtue of actual injection time departing only relatively slightly in relation to theoretical injection time.

With this aim in view, according to the present invention, there is provided a system for converting a signal from a substantially linear transducer detecting a parameter on a motor vehicle electronic injection system, and so enabling parameter acquisition to varying degrees of accuracy; characterized by the fact that it comprises electronic means comprising at least one amplifier, for supplying at least one signal differing in slope as compared to that supplied by said transducer; and processing means for determining the value of said parameter to a degree of accuracy depending on the modified slope of said signal from said electronic means.

BRIEF DESCRIPTION OF THE DRAWINGS

A number of non-limiting embodiments of the present invention will be described by way of examples with reference to the accompanying drawings, in which:

FIG. 6 shows an alternative embodiment of the FIG. 3 blocks;

FIG. 7 shows variations in the transducer signal affected by the FIG. 6 blocks;

DETAILED DESCRIPTION OF THE INVENTION

Figure 1:
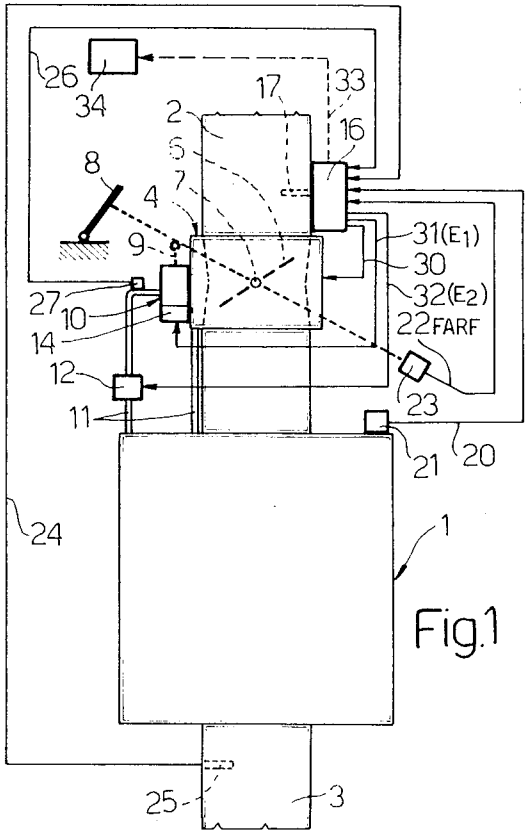
FIG. 1 shows a schematic view of an electronic injection system for an internal combustion engine, featuring the signal conversion system according to the present invention.

FIG. 1 shows an electronic fuel injection system featuring the signal conversion system according to the present invention, and of the type described in Italian Patent Application entitled "Electronic fuel injection system for an internal combustion engine" filed on the same date by the present Applicant, and the content of which is included herein purely by way of reference as required. Number 1 in FIG. 1 indicates, schematically, a motor vehicle internal combustion engine having an intake pipe 2 and an exhaust pipe 3. Said intake pipe 2 is fitted inside with an electronic injection unit 4 conveniently consisting of a single-point injector. At said unit 4, said intake pipe 2 is also fitted with a main throttle 6 having a rotary shaft 7 the setting of which is controlled mechanically by a pedal-operated accelerator 8. The minimum rotation position of said shaft 7 is controlled mechanically by a piston 9 of a heat-sensitive element 10 conveniently containing a wax mixture and, for example, of the type described in Italian Patent Application No. 67105-A/87 filed on 17 Feb., 1987 by the present Applicant. Said heat-sensitive element 10, which is supported on injection unit 4, is thermally connected directly to an electric heating element 14, and is arranged in thermal contact with a circuit 11 for recirculating the engine cooling water and featuring a solenoid valve 12.

Number 16 indicates an electronic control system mounted on intake pipe 2, for controlling the injection system. Said control system 16 is fitted directly with a substantially known type of sensor 17 for detecting the temperature of the air supply to engine 1, and therefore located in such a manner as to be swept by the air flow along pipe 2.

Control system 16 receives:

- a first signal 20 from the primary circuit of ignition coil 21, for detecting the speed of engine 1;
- a second signal 22 (FARF) indicating the setting of throttle 6 and supplied by a conveniently single-track, substantially linear potentiometer 23 connected in known manner to shaft 7;
- a third signal 24 supplied by a substantially known sensor 25 in exhaust pipe 3, for detecting the concentration of at least one exhaust gas component and possibly comprising a CO detector;
- a fourth signal 26 supplied by a sensor 27 connected to circuit 11, for detecting the temperature of the cooling water of engine 1.

Control system 16, in turn, supplies:

- a first signal 30 for controlling the single-point injector of unit 4;
- a second signal 33 for controlling an optical and/or acoustic alarm device 34;
- a pair of signals 31 (E1) and 32 (E2) for respectively controlling electric heating element 14 and solenoid valve 12.

Figure 2:
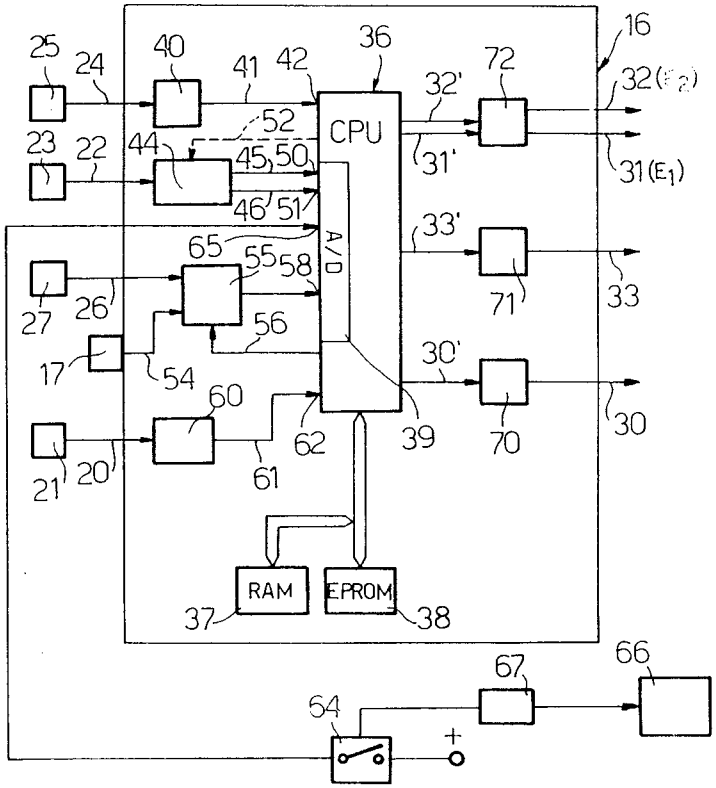
FIG. 2 shows a block diagram of the electronic control system on the FIG. 1 injection system, featuring the signal conversion system according to the present invention.

FIG. 2 shows a more detailed view of control system 16, which comprises a microprocessor-based central processing unit (CPU) 36 connected to RAM and EPROM memory blocks 37 and 38, and fitted directly with an 8-bit analogue-digital converter block 39 with a relatively small number of inputs (in this case, four). Under normal operating conditions of engine 1 and sensor 25, signal 24 supplied by sensor 25 flickers above and below an intermediate range of values defining a substantially correct stoichiometric ratio of the air/fuel mixture being supplied. Said signal 24 is supplied directly to block 40 of control system 16, which block 40 comprises an amplifying circuit (usually for amplifying signal 24 from 0/1 V to approximately 3 V) followed by a threshold comparator circuit (e.g. a Schmitt trigger). Block 40 therefore supplies a digital output signal 41 indicating the concentration of the exhaust gases (rich or lean mixture), which is sent directly to digital input 42 of central processing unit 36.

Signals 26 and 54, supplied respectively by sensors 27 and 17 for detecting the cooling water and air supply temperatures of engine 1, are sent to respective inputs of a selecting block 55 of control system 16. Block 55 is controlled by a digital signal 56 supplied by processing unit 36, for selecting which signal to supply to the output of block 55 connected to analogue input 58 of analogue-digital converter block 39.

The speed of engine 1 is indicated by signal 20 on the primary circuit of ignition coil 21. This presents an initial oscillation of approximately 200 V, and a cycle, depending on the speed of engine 1, ranging for example between 5 milliseconds (maximum engine speed) and 45 milliseconds (idling speed). Said signal 20 is supplied to block 60 of control system 16, which comprises, for example, a flip-flop supplying a squarewave output signal 61 (SMOT) of approximately 3 milliseconds, and the frequency of which is therefore a function of the speed of engine 1. Said signal 61 is supplied to digital input 62 of central processing unit 36, by which it is processed in the normal manner, e.g. by means of counters, to give the required control parameter.

The positive system supply voltage from the vehicle battery is also supplied, via a switch block 64 controlled by the vehicle ignition key, to analogue input 65 of analogue-digital converter block 39. Said switch block 64 also supplies an electric pump 66, for supplying fuel to injection unit 4, via an inertial type relay block 67, i.e. designed to open in the event of the vehicle being arrested sharply, as in the case of collision.

Central processing unit 36 then supplies signals 30', 33', and a pair of signals 31', 32', which, via respective pilot blocks 70, 71 and 72, determine control signals 30, 33, and 31, 32.

Figure 4:
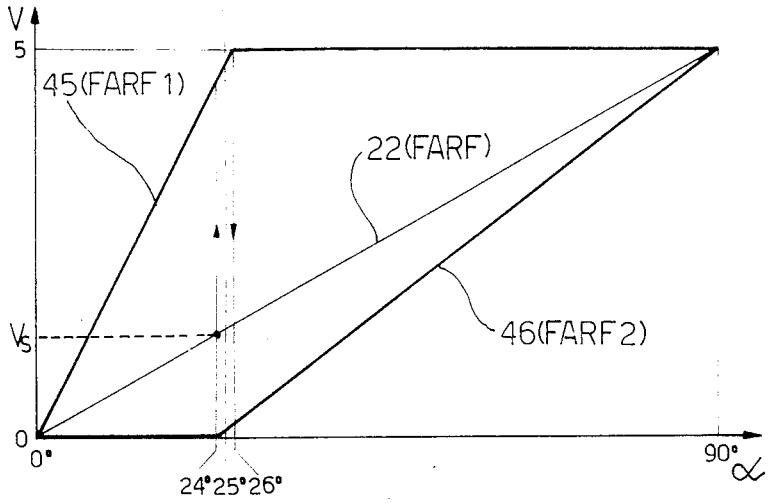
FIG. 4 shows variations in the transducer signal affected by the FIG. 3 blocks.

Signal 22 (FARF) supplied by potentiometer 23 is a linear signal, i.e. the voltage of which is directly proportional to the setting angle ($\alpha$) of throttle 6, as shown in FIG. 4. In particular, for a throttle 6 setting ranging from 0° to 90°, signal 22 ranges from 0 to 5 volts, and, together with 8-bit analogue-digital converter 39, provides for an acquisition resolving capacity of 0.35° per bit.

For enabling various throttle 6 setting ranges to be determined to varying degrees of accuracy, and so reducing (e.g. to 2%) the maximum reading error percentage of transducer 23 reflected in control signal 30 supplied to injection unit 4, said signal 22 is supplied to block 44 of control system 16 (FIG. 2) which supplies output signals 45 (FARF1) and 46 (FARF2) of differing slope, as shown in FIG. 4, for throttle 6 setting ranges ($\alpha$) respectively above and below roughly 25°. In actual practice, a small intermediate range may exist wherein both the significant values of signals 45 and 46 overlap. As shown in FIG. 4, output signal 45 (FARF1) commences at the origin and rises to 5 V at an angle ($\alpha$) of 26°, with a slope defining a resolving capacity of 0.1° per bit; whereas output signal 46 (FARF2) commences at 0 V and an angle of 24°, and rises to 5 V at 90°, with a more gradual slope as compared with signal 45, and such as to define a resolving capacity of 0.25° per bit. This therefore gives an overlapping intermediate range of 2°.

Figure 3:
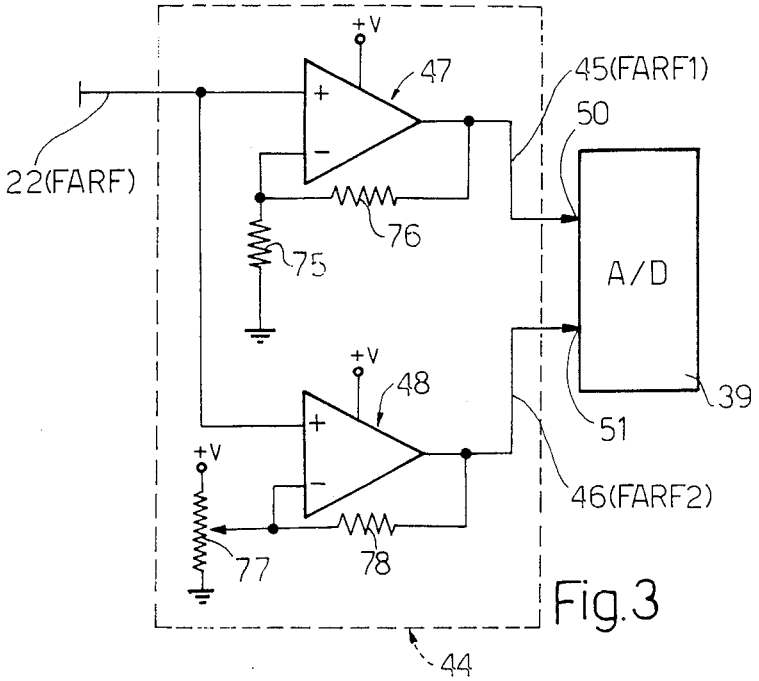
FIG. 3 shows a more detailed block diagram of a component block in FIG. 2.

As shown by way of example in FIG. 3, said block 44 conveniently comprises two amplifiers 47 and 48 providing for differing amplification of input signal 22 supplied to their respective non-inverting inputs. Said amplifiers 47 and 48 are supplied with +5 V (to give a maximum voltage of 5 V for signals 45 and 46). Whereas amplifier 47 presents a resistor 75 connected between its inverting input and ground, and a resistor 76 connected between its output and inverting input, amplifier 48 presents a resistor 78 connected between its output and inverting input, which is in turn connected to the cursor of a potentiometer 77 connected between a +V terminal and ground. The voltage (Vs) on the cursor can be regulated for selecting the starting angle ($\alpha$) of signal 46 (FARF2) as shown in FIG. 4. The outputs of amplifiers 47 and 48 are connected to respective analogue inputs 50 and 51 of analogue-digital converter block 39.

FIG. 6 shows an alternative embodiment of block 44, presenting only one amplifier 80 supplied at its non-inverting input with signal 22. The advantage of the FIG. 6 arrangement over the one shown in FIG. 3 is that the offset voltage of the second amplifier need no longer be calibrated in relation to the first. Amplifier 80 is similar to amplifier 47 in FIG. 3, except that it presents two resistors 82 and 83 connected parallel between the inverting input and ground, and totaling the value of resistor 75 in FIG. 3. The series ground connection of resistor 83 is opened or closed by an electronic switch 84 controlled by a digital signal 52 from central processing unit 36. When electronic switch 84 is closed, the gain of amplifier 80 equals that of amplifier 47 in FIG. 3 (A1). When switch 84 is open, the gain of amplifier 80 is reduced to a value A2.

FIG. 7 shows:

- the characteristic of signal 22 (FARF) supplied directly by transducer 23, and ranging from 0 to 5 volts for a 0° to 90° setting of throttle 6, to give a resolving capacity of 0.35° per bit;
- the characteristic of signal 45 (FARF1) from amplifier 80 with switch 84 closed, and ranging from 0 to 5 volts for a 0° to 25° setting of throttle 6, to give a resolving capacity of 0.1° per bit;
- the characteristic of signal 46' (FARF2)' from amplifier 80 with switch 84 open, and ranging from 0 to 5 volts for a 0° to 45° setting of throttle 6, to give a resolving capacity of 0.2° per bit.

Depending on control signal 52, signal 45 (FARF1) or 46' (FARF2)' at the output of amplifier 80 is supplied to input 51 of analogue-digital converter 39, the other input 50 of which is supplied directly with signal 22 (FARF).

Figure 5:
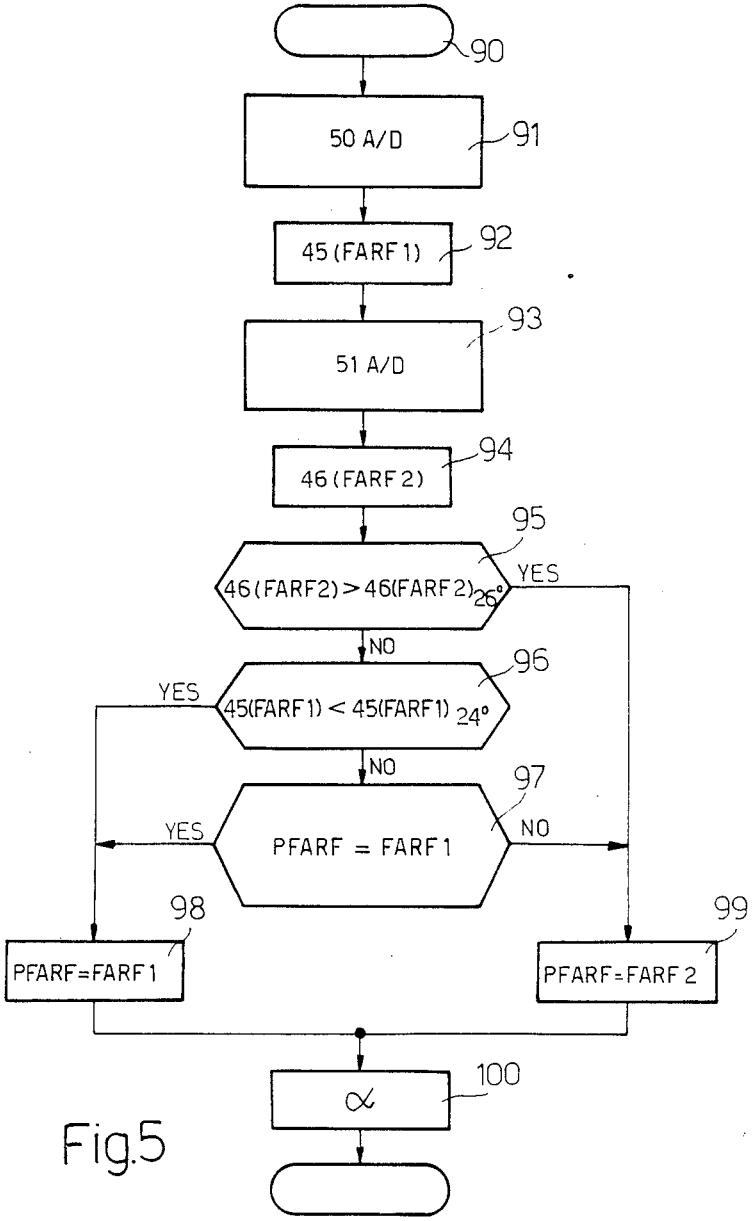
FIG. 5 shows a block diagram of the central processing unit on the FIG. 2 control system, operating on the signals received from the FIG. 3 blocks.

FIG. 5 shows the subroutine of central processing unit 36 whereby the output signals from block 44 in FIG. 3 are received and processed to give the angle ($\alpha$) detected by transducer 23. Said subroutine is repeated periodically, e.g. at intervals of ten milliseconds, by the main program of processing unit 36. As shown in FIG. 5, starting block 90 goes to block 91, which provides for digital conversion, via block 39, of signal 45 (FARF1) at input 50. Block 91 then goes on to block 92, which, after storing said digital value of signal 45, goes on to block 93, which provides for digital conversion, via block 39, of signal 46 (FARF2) at input 51, and then goes on to block 94 by which said digital value of signal 46 is stored. Block 94 then goes on to block 95, which determines whether the digital value of signal 46 stored in block 94 is greater than that of signal 46 corresponding to an angle ($\alpha$) of 26° (FIG. 4).

In the event of a positive response, i.e. indicating that the actual angle of throttle 6 is currently greater than 26°, block 95 goes on to block 99, which enters the FARF2 value from block 94 into the PFARF memory register, indicating the value of the signal detected by transducer 23, together with an indication (e.g. a flag) that said value relates to the FARF2 signal (FIG. 4) stored in central processing unit 36.

In the event of a negative response in block 95, this goes on to block 96, which determines whether the digital value of signal 45 stored in block 92 is less than that of signal 45 corresponding to an angle ($\alpha$) of 24° (FIG. 4). In the event of a positive response, i.e. indicating that the actual angle of throttle 6 is currently less than 24°, block 96 goes on to block 98, which enters the FARF1 value from block 92 into the PFARF memory register, indicating the value of the signal detected by transducer 23, together with an indication (e.g. a flag) that said value relates to the FARF1 signal (FIG. 4) stored in central processing unit 36. In the event of a negative response n block 96, this means that the actual angle of throttle 6 is currently between 24° and 26°, i.e. in the overlapping range of signals FARF1 and FARF2, wherein these are no longer linear. The system therefore provides for maintaining the signal selection made in the previous cycle, and block 96 goes on to block 97, which determines whether the FARF1 value has been stored in the PFARF memory register. In the event of a positive response, block 97 goes on to block 98, which provides for storing the current cycle FARF1 value from block 92. In the event of a negative response in block 97, this goes on to block 99, which provides for storing the current cycle FARF2 value from block 94. Both blocks 98 and 99 go on to block 100, which determines the value of the $\alpha$ parameter (throttle 6 setting) as a function of the stored PFARF value and the selected signal.

Figure 8:
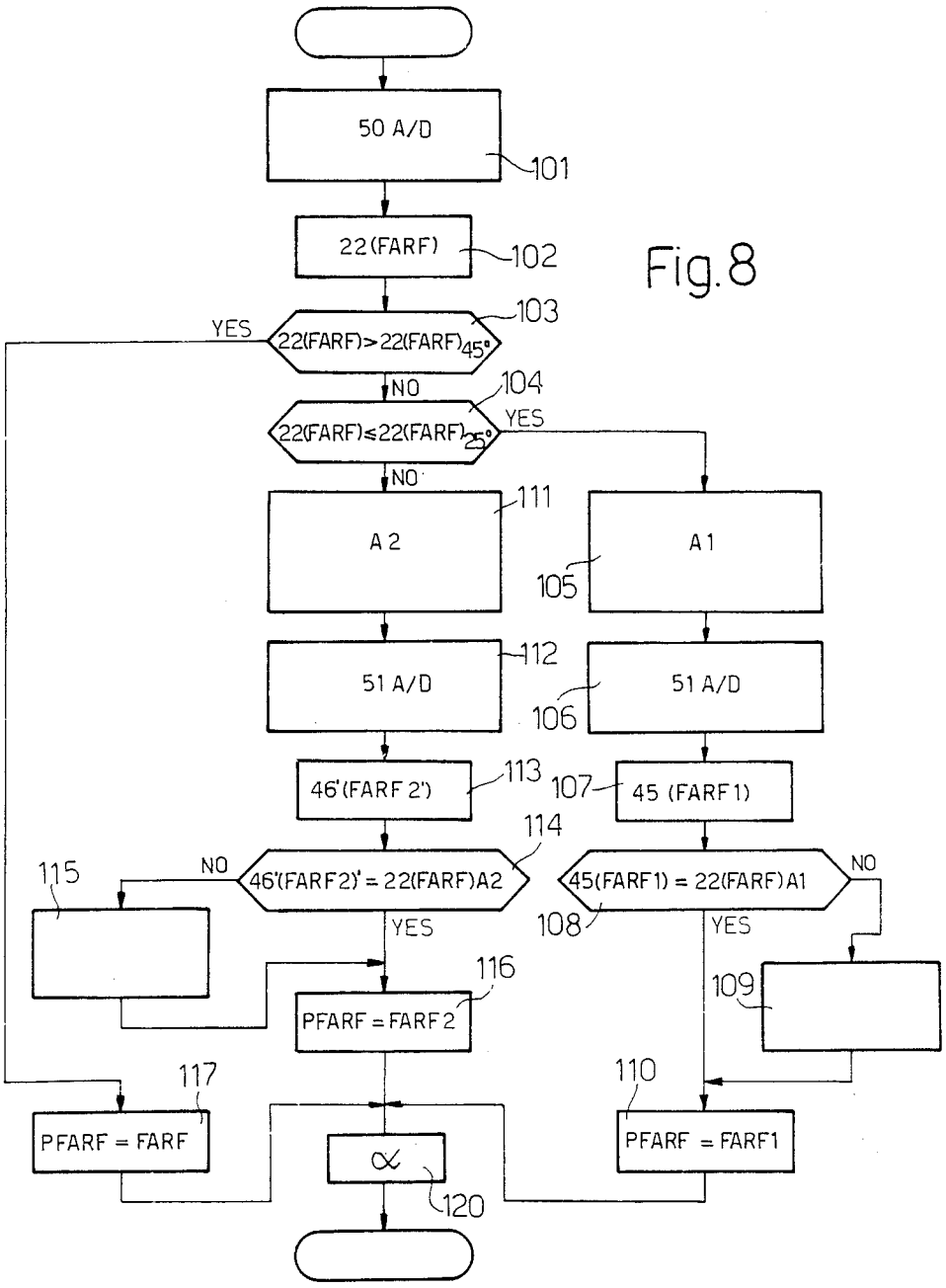
FIG. 8 shows a block diagram of the central processing unit on the FIG. 2 control system, operating on the signals received from the FIG. 6 blocks.

FIG. 8 shows the subroutine of central processing unit 36 for receiving and processing the output signals of block 44 in FIG. 6. As shown in FIG. 8, the starting block goes to block 101, which provides for digital conversion, via block 39, of signal 22 (FARF) at input 50. Block 101 then goes on to block 102, which, after storing said digital value of signal 22, goes on to block 103, wich determines whether the digital value of signal 22 stored in block 102 is greater than that of signal 22 corresponding to an angle ($\alpha$) of 45° (FIG. 7).

In the event of a positive response, i.e. indicating that the actual angle of throttle 6 is currently greater than 45°, block 103 goes on to block 117, which enters the FARF value from block 102 into the PFARF memory register, indicating the value of the signal detected by transducer 23, together with an indication (e.g. a flag) that said value relates to the FARF signal (FIG. 7) stored in central processing unit 36.

In the event of a negative response in block 103, this goes on to block 104, which determines whether the digital value of signal 22 stored in block 102 is less than that of signal 22 corresponding to an angle ($\alpha$) of 25° (FIG. 7). In the event of a positive response, this means the actual angle of throttle 6 is currently less than 25°, thus indicating selection of signal 45 (FARF1). Block 104 therefore goes on to block 105, which, via signal 52, closes electronic switch 84 to give a gain A1 on amplifier 80. Block 105 then goes on to block 106, which provides for digital conversion, via block 39, of signal 45 (FARF1) at input 51, and then goes on to block 107 by which said digital value of signal 45 is stored. Block 107 then goes on to block 108, which determines whether the digital value of signal 45 (FARF1) matches the theoretical value of signal 22 (FARF) multiplied by the theoretical gain A1 of amplifier 80. In the event of a positive response, i.e. no drift error involved, block 108 goes on to block 110, which enters the FARF1 value from block 107 into the PFARF memory register, indicating the value of the signal detected by transducer 23, together with an indication (e.g. a flag) that said value relates to the FARF1 signal (FIG. 7) stored in central processing unit 36. In the event of a negative response in block 108, i.e. indicating an error in the signal from amplifier 80, block 108 goes on to block 109, which corrects the FARF1 value to equal the theoretical value of signal 22 multiplied by gain A1, and enters it into the FARF1 memory register of block 107. Block 109 then goes on to block 110, which, operating as already described, enters the corrected FARF1 value into the PFARF register.

In the event of a negative response in block 104, this means the actual angle of throttle 6 is currently between 25° and 45°, thus indicating selection of signal 46'

(FARF2)'. Block 104 therefore goes on to block 111, which, via signal 52, opens electronic switch 84 to give a gain A2 on amplifier 80. Block 111 then goes on to block 112, which provides for digital conversion, via block 39, of signal 46' (FARF2)' at input 51, and then goes on to block 113 by which said digital value of signal 46' is stored. Block 113 goes on to block 114, which determines whether the digital value of signal 46' (FARF2)' matches the theoretical value of signal 22 (FARF) multiplied by the theoretical gain A2 of amplifier 80. In the event of a positive response, i.e. no drift error involved, block 114 goes on to block 116, which enters the FARF2' value from block 113 into the PFARF memory register, indicating the value of the signal detected by transducer 23, together with an indication (e.g. a flag) that said value relates to the FARF2' signal (FIG. 7) stored in central processing unit 36. In the event of a negative response in block 114, i.e. indicating an error in the signal from amplifier 80, block 114 goes on to block 115, which corrects the FARF2' value to equal the theoretical value of signal 22 multiplied by gain A2, and enters it into the FARF2' memory register of block 113. Block 115 then goes on to block 116, which, operating as already described, enters the corrected FARF2' value into the PFARF register.

Blocks 117, 110 and 116 all go on to block 120, which determines the value of the $\alpha$ parameter (throttle 6 setting) as a function of the stored PFARF value and the selected signal.

The advantages of the signal conversion system according to the present invention will be clear from the foregoing description. By means of relatively straightforward circuitry and a small number of processing unit blocks, a straightforward linear transducer may be employed for producing signals of different slopes for various parameter ranges, depending on the parameter reading accuracy required. Moreover, it also provides for correcting any errors automatically. When applied, as described herein, to an internal combustion engine electronic fuel injection system, it provides for a relatively low-cost system and satisfactory performance, by virtue of providing for an injection time error percentage of no more than a few percent.

To those skilled in the art it will be clear that changes may be made to the embodiments described and illustrated herein without, however, departing from the scope of the present invention. For example, numerous changes may be made to the configuration of block 44, which may present additional amplifying blocks with different amplification coefficients and adjustable thresholds, for producing additional signals of differing slopes relative to different parameter ranges. Also, the FIGS. 3 and 6 arrangements may be combined to feature amplifying blocks having output signals supplied permanently to the processing unit, and/or further fixed-gain amplifying blocks with selectable outputs, or varying in gain as a function of control signals from the processing unit.

We claim:

1. A system for converting a signal (22) from a substantially linear transducer (23) detecting a parameter on a motor vehicle electronic injection system, and so enabling parameter acquisition to varying degrees of accuracy; characterised by the fact that it comprises electronic means (44) comprising at least one amplifier (47, 48) for supplying at least one signal (FARF1, FARF2) differing in slope as compared to that (FARF) supplied by said transducer (23), processing means (36) for determining the value of said parameter to a degree of accuracy depending on the modified slope of said signal (FARF1, FARF2) from said electronic means (44), said electronic means (44) having at least two amplifiers (47, 48) supplied with said signal (22) from said transducer (23), and supplying respective output signals (45, 46) to said processing means (36), said processing means further having means (92, 94) for storing the output signals (45, 46) from said amplifiers (47, 48); means (95, 96) for selecting a respective said signal (FARF1, FARF2); means (96) for determining whether the value of said parameter falls within a range wherein said signals (FARF1, FARF2) overlap; and, if it does, means (97) for determining whether said signal (FARF1) has been stored in (FARF) memory register.

2. A system as claimed in claim 1, characterised by the fact that said electronic means (44) are designed to supply a number of said signals (FARF1, FARF2) of different slopes; and that said processing means (36) are designed to select a respective said signal for a specific range of the parameter detected by said transducer (23).

3. A system as claimed in claim 1, characterised by the fact that said two amplifiers (47, 48) present different gains.

4. A system as claimed in claim 1, characterised by the fact that said processing means (36) comprise an analogue-digital converter block (39) supplied with the signals from said electronic means (44).

5. A system as claimed in claim 4, characterised by the fact that said transducer (23) is an angle transducer.

6. A system as claimed in claim 1, characterised by the fact that said transducer (23) is a single-track potentiometer.

7. A system as claimed in claim 1, characterised by the fact that said transducer (23) detects the setting of a throttle (6) regulating air supply to said engine (1).

8. A system as claimed in claim 7, characterised by the fact that said injection system comprises an electronic control system (16) comprising a central processing unit (36) designed to receive signals from means (21) detecting the speed of said engine (1), from said transducer (23) detecting the setting of said throttle (6) regulating air supply to said engine (1), from engine exhaust gas detecting means (25), from means (27) detecting engine cooling water temperature, and from means (17) detecting engine air supply temperature.

9. A system as claimed in claim 8, characterised by the fact that said processing means (36) form part of said central processing unit (36) of said injection system.

10. A system as claimed in claim 5, characterised by the fact that said analogue-digital converter block (39) is an 8-bit type; that said transducer (23) presents a reading precision of a few percent; and that said signals are acquired to a final accuracy of a few tenths of a degree per bit.

11. A vehicle engine electronic fuel injection system, characterised by the fact that it comprises a system for converting a signal from a substantially linear transducer as claimed in claim 1.

12. A system for converting a signal (22) from a substantially linear transducer (23) detecting a parameter on a motor vehicle electronic injection system, and so enabling parameter acquisition to varying degrees of accuracy; characterised by the fact that it comprises electronic means (44) comprising at least one amplifier (47, 48), for supplying at least one signal (FARF1, FARF2) differing in slope as compared to that (FARF) supplied by said transducer (23), said transducer (23)

being an angle-transducer, processing means (36) for determining the value of said parameter to a degree of accuracy depending on the modified slope of said signal (FARF1, FARF2) from said electronic means (44), said processing means (36) having an analogue-digital converter block (39) supplied with the signals from said electronic means (44), said analogue-digital converter block (39) being an 8-bit type; said transducer (23) further presenting a reading precision of a few percent; and that said signals are acquired to a final accuracy of a few tenths of a degree per bit.

13. A system as claimed in claim 12, characterised by the fact that said electronic means (44) comprise at least one amplifier (80) supplied with said signal (22) from said transducer (23), and the gain of which is variable via means (84) controlled by said processing means (36).

14. A system as claimed in claim 13, characterised by the fact that said means controlled by said processing means comprise an electronic switch (84) for connecting or disconnecting a resistor (83) at the input of said amplifier (80).

15. A system as claimed in claim 13, characterised by the fact that said signal (22) from said transducer (23) is also supplied directly to said electronic means (44).

16. A system as claimed in claim 15, characterised by the fact that said processing means (36) comprise means (102) for storing the direct output signal (22) from said transducer (23); and means (103, 104) for determining the range of the parameter detected by said transducer (23) and selecting a respective signal, and possibly communicating with means (104) for selecting the gain of said amplifier (80).

17. A system for converting a signal (22) from a substantially linear transducer (23) detecting a parameter on a motor vehicle electronic injection system, and so enabling parameter acquisition to varying degrees of accuracy; characterised by the fact that it comprises electronic means (44) comprising at least one amplifier (47, 48), for supplying at least one signal (FARF1, FARF2) differing in slope as compared to that (FARF) supplied by said transducer (23), said transducer (23) detecting the setting of a throttle (6) regulating air supply to said engine (1) processing means (36) for determining the value of said parameter to a degree of accuracy depending on the modified slope of said signal (FARF1, FARF2) from said electronic means (44), said processing means (36) forms part of said central processing unit (36) of said injection system, said injection system having an electronic control system (16) comprising a central processing unit (36) designed to receive signals from means (21) for detecting the speed of said engine (1), from said transducer (23) detecting the setting of said throttle (6) regulating air supply to said engine (1), from means for detecting engine exhaust gas (25), from means for detecting engine cooling water temperature (27), and from means for detecting engine air supply temperature (17).

* * * * *